US011305900B2

(12) United States Patent
Jackson et al.

(10) Patent No.: US 11,305,900 B2
(45) Date of Patent: Apr. 19, 2022

(54) BANDING MACHINE

(71) Applicants: ALLIANCE RUBBER COMPANY, Hot Springs, AR (US); JMM-585, LLC, Fayetteville, AR (US)

(72) Inventors: Joseph C. Jackson, Malvern, AR (US); Gary W. Castleberry, Jessieville, AR (US); Jordan W. Steinhaus, Hot Springs, AR (US); Brandon R. Hughes, Donaldson, AR (US); James R. Maynard, Farmington, AR (US); Joseph M. Maynard, Fayetteville, AR (US); Zachary D. Zelenka, Fayetteville, AR (US); Cory N. Hatcher, Springdale, AR (US)

(73) Assignees: Alliance Rubber Company, Hot Springs, AR (US); JMM-585, LLC, Fayetteville, AR (US)

( * ) Notice: Subject to any disclaimer, the term of this patent is extended or adjusted under 35 U.S.C. 154(b) by 12 days.

(21) Appl. No.: 16/375,964

(22) Filed: Apr. 5, 2019

(65) Prior Publication Data

US 2019/0308759 A1 Oct. 10, 2019

Related U.S. Application Data

(60) Provisional application No. 62/655,480, filed on Apr. 10, 2018.

(51) Int. Cl.
*B65B 13/16* (2006.01)
*B65B 57/10* (2006.01)
(Continued)

(52) U.S. Cl.
CPC ..... *B65B 13/16* (2013.01); *B65B 13/022* (2013.01); *B65B 29/00* (2013.01); *B65B 57/10* (2013.01)

(58) Field of Classification Search
CPC ..... B65B 13/02; B65B 13/022; B65B 13/16; B65B 27/10; B65B 25/023; B65B 25/04; B65B 57/10
(Continued)

(56) References Cited

U.S. PATENT DOCUMENTS 2,049,823 A * 8/1936 Reichert, Jr. ..... B26F 1/382 30/273
2,516,292 A 7/1950 Bennett
(Continued)

FOREIGN PATENT DOCUMENTS

CA 978036 11/1975
CA 2 505 549 A1 10/2006 ..... B65B 27/00
(Continued)

*Primary Examiner* — Joshua G Kotis
(74) *Attorney, Agent, or Firm* — Renner, Kenner, Greive, Bobak, Taylor & Weber

(57) ABSTRACT

A banding machine includes a tube guide adapted to transfer an elastomeric tube from an entry end to an exit end. A frame assembly receives the elastomeric tube from the exit end. A drive assembly is carried by the frame assembly and includes a drive shaft which rotates a drive wheel that advances the elastomeric tube through the frame assembly. A knife guide assembly receives a reciprocating knife to cut the elastomeric tube to form a band. A stretcher assembly with stretcher fingers maintained substantially adjacent one another in a first position receives the band, the stretcher fingers then expand the band to a second position to receive an object upon which the band closes around.

16 Claims, 17 Drawing Sheets

(51) Int. Cl.
*B65B 13/02* (2006.01)
*B65B 29/00* (2006.01)

(58) Field of Classification Search
USPC ..... 100/6, 9; 53/399, 582, 585
See application file for complete search history.

(56) References Cited

U.S. PATENT DOCUMENTS 3,126,780 A * 3/1964 Booth ..... B23D 19/04 83/500
3,186,333 A * 6/1965 Hoffman ..... B65B 13/022 100/9
3,313,090 A 4/1967 Kerrigan
3,756,485 A 9/1973 Abrecht ..... 226/44
3,843,438 A 10/1974 Gabriel
3,974,628 A * 8/1976 Konstantin ..... B29C 63/423 53/291
3,974,762 A 8/1976 Kita et al. ..... 100/9
4,055,934 A * 11/1977 Leveugle ..... B65B 13/022 53/585
4,079,875 A 2/1978 Zadrow
4,095,391 A 6/1978 Anguiano ..... 53/123
4,098,636 A 7/1978 Gabriel
4,102,728 A * 7/1978 Smith ..... B65C 3/065 156/362
4,127,978 A * 12/1978 Lucke ..... B65B 13/022 100/9
4,165,595 A * 8/1979 Pilley ..... B65B 53/00 53/556
4,401,020 A 8/1983 Brux ..... 100/7
4,442,765 A 4/1984 Limehouse et al. ..... 100/6
4,519,178 A 5/1985 Crabb, Jr.
4,570,415 A * 2/1986 Centeno ..... B65B 13/022 53/390
4,601,155 A * 7/1986 Lewis ..... B65B 13/022 53/176
5,588,278 A 12/1996 Wynn et al. ..... 53/399
5,733,652 A 3/1998 Stowman et al.
5,787,777 A * 8/1998 Ballestrazzi ..... B26D 1/095 83/100
6,279,255 B1 8/2001 Larsen
6,523,331 B1 * 2/2003 Fresnel ..... B65B 9/14 493/273
7,257,934 B2 8/2007 Swift et al. ..... 53/399
7,281,345 B2 10/2007 Ludlow et al.
7,565,789 B2 7/2009 Lucas et al. ..... 53/582
8,621,745 B2 1/2014 Deonarine et al. ..... 29/775
8,746,136 B2 6/2014 Corbin ..... 100/9
9,834,330 B2 * 12/2017 Burke ..... B65C 3/00
2005/0173073 A1 8/2005 Chernoff
2006/0086028 A1 4/2006 Vaughan
2010/0089005 A1 * 4/2010 Swift ..... B65B 27/10 53/399
2010/0107563 A1 5/2010 Swift et al. ..... 53/399
2014/0331604 A1 11/2014 Kuehl et al. ..... 53/410
2018/0350275 A1 12/2018 Milbrandt et al.

FOREIGN PATENT DOCUMENTS

FR 2300009 9/1975 ..... B65B 13/16
GB 1 396 468 6/1975 ..... B65H 67/00
WO 2012/061063 A1 5/2012

* cited by examiner

BANDING MACHINE

CROSS-REFERENCE TO RELATED APPLICATIONS

This application claims priority of U.S. Provisional Application Ser. No. 62/655,480 filed Apr. 10, 2018, which is incorporated herein by reference.

TECHNICAL FIELD

The present invention is directed to a machine that cuts an elastomeric tube to length into a band and then presents the cut band in an expanded condition for placement over an object.

BACKGROUND ART

Banding machines are used for many purposes. At the most general level, banding machines take an elastic band, which may be pre-cut or not, and expands the band to form a sufficiently sized opening. Next, a group of items are manually or machine-fed into the expanded band an appropriate distance. The band is then released on the group of items in any number of ways to hold them in place, whereupon the banded items are moved away from the machine to allow for the next banding cycle. The primary advantage of the banding machine is to replace a slow and many times inadequate manual banding operation. Banding machines provide accurate and repeatable installations of a cut band which is more cost effective than a manual banding operation.

Banding machines may be especially adapted for many different uses, such as rolling and holding newspapers into roll form; bundling flower stems together; holding vegetable stalks, such as broccoli, together; clothing items; goods to be sold; and so on. Elastic bands are ideal for when the items to be bundled are of slightly different size. However, elastic bands can be difficult to work with because of differences in their elastic properties and how the bands are used in a particular end application. Accordingly, banding machines must be adaptable to any number of end-use applications.

By way of a non-limiting example, a lobster has two claws one of which is very weak relative to the other, the crusher-claw. The lobster will clutch at anything coming into contact with the crusher-claw—even its own tail—so that when live lobsters are shipped from one location to another a lobster may either injure itself or an adjacent lobster. It is common practice, therefore, to provide means preventing the lobster from employing its crusher-claw in such a fashion during shipment and even after, should it be stored in a live-lobster tank. Heretofore, it has been standard practice to either cut the tendon behind the crusher-claw or to insert a small wooden peg into the claw so as to hold the latter in check. However, inasmuch as both of these methods were slow and not always effective, and because the pegs have at times caused the lobster meat to go bad, elastic bands have been used. As the opening power of a lobster's claw is quite weak, elastic bands have proved to be satisfactory and sufficiently strong to maintain the claw in a closed inoperative position.

Unfortunately, hand placement of elastic bands on a lobster claw, or any other object which needs to be held together such as an oyster, a group of vegetables, sticks, or the like, often requires repetitive hand motions, even if using specially designed tools. As a result, workers suffer from carpal tunnel syndrome and other motion related injuries.

Moreover, lobster banding operations often take place on a rollicking boat further increasing the difficulty of the manual task.

Banding machines for securing objects such as lobster claws and the like with an elastic band eliminate the repetitive hand motions, but are ineffective in their stated purpose. Oftentimes, the machines do not cleanly cut a band to length, or the machine becomes easily jammed and rendered inoperative. Moreover, the machines are difficult to un-jam and clean. Still another drawback of such machines is that they sometimes limit the depth the object can be inserted so that the band cannot be placed at an optimal position on the object. This then requires time-wasting repositioning, by hand, of the band on the object. Prior art machines are also prone to breakage.

Based on the foregoing deficiencies in manual and machine banding operations, there is a clear need in the art for an automated banding machine adaptable for use with objects of various diameter and length. Moreover, there is a clear need for an automated banding machine that operates in factory or boat settings, has modular components which can be easily replaced for easy servicing, and which minimizes operator fatigue.

SUMMARY OF THE INVENTION

In light of the foregoing, it is a first aspect of the present invention to provide a banding machine.

It is another aspect of the present invention to provide a banding machine, comprising a tube guide adapted to transfer an elastomeric tube from an entry end to an exit end, a frame assembly associated with the tube to receive the elastomeric tube from the exit end, a drive assembly carried by the frame assembly, the drive assembly comprising a drive shaft selectively rotating a drive wheel which advances the elastomeric tube through the frame assembly, a knife guide assembly associated with the frame assembly, the knife guide assembly receiving a reciprocating knife to cut the elastomeric tube to form a band, and a stretcher assembly having stretcher fingers maintained substantially adjacent one another in a first position and adapted to receive the band, wherein the stretcher fingers are movable away from each other to expand the band to a second position to receive an object upon which the band closes around.

It is still another aspect of the present invention to provide a banding machine for placing an elastomeric band around an object, comprising a drive assembly that receives and selectively advances an elastomeric tube, a knife guide assembly that receives the advanced elastomeric tube and which receives a knife that cuts the elastomeric tube to form the elastomeric band, and a stretcher assembly having at least two fingers to receive and expand the band around the object, wherein the drive assembly advances the elastomeric tube to move the cut elastomeric band on to the at least two stretcher fingers.

It is yet another aspect of the present invention to provide a banding machine system, comprising a housing having an opening, a drive assembly maintained within the housing and selectively moving an elastomeric tube, a knife maintained within the housing and selectively cutting the elastomeric tube into an elastomeric band, a pair of stretcher arms to receive the elastomeric band in a first position within the housing and expand the elastomeric band to a second position through the opening outside the housing, and a controller associated with the drive assembly, the knife and the pair of stretcher arms to control operation thereof.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1A:
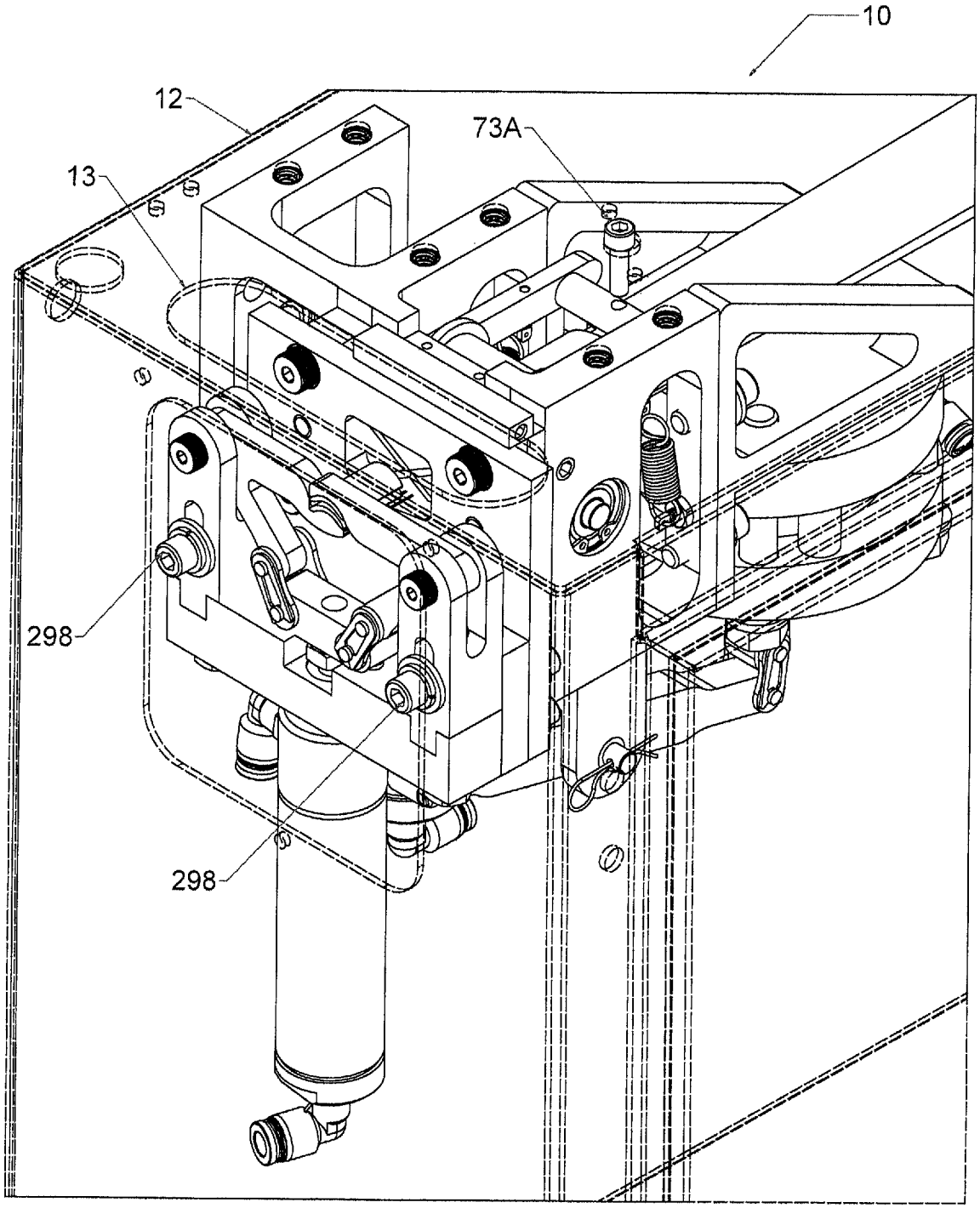
FIG. 1A is a perspective view of a banding machine in a housing and FIG. 1B is a corresponding exploded perspective view of just the banding machine according to the concepts of the present invention.
Figure 1B:
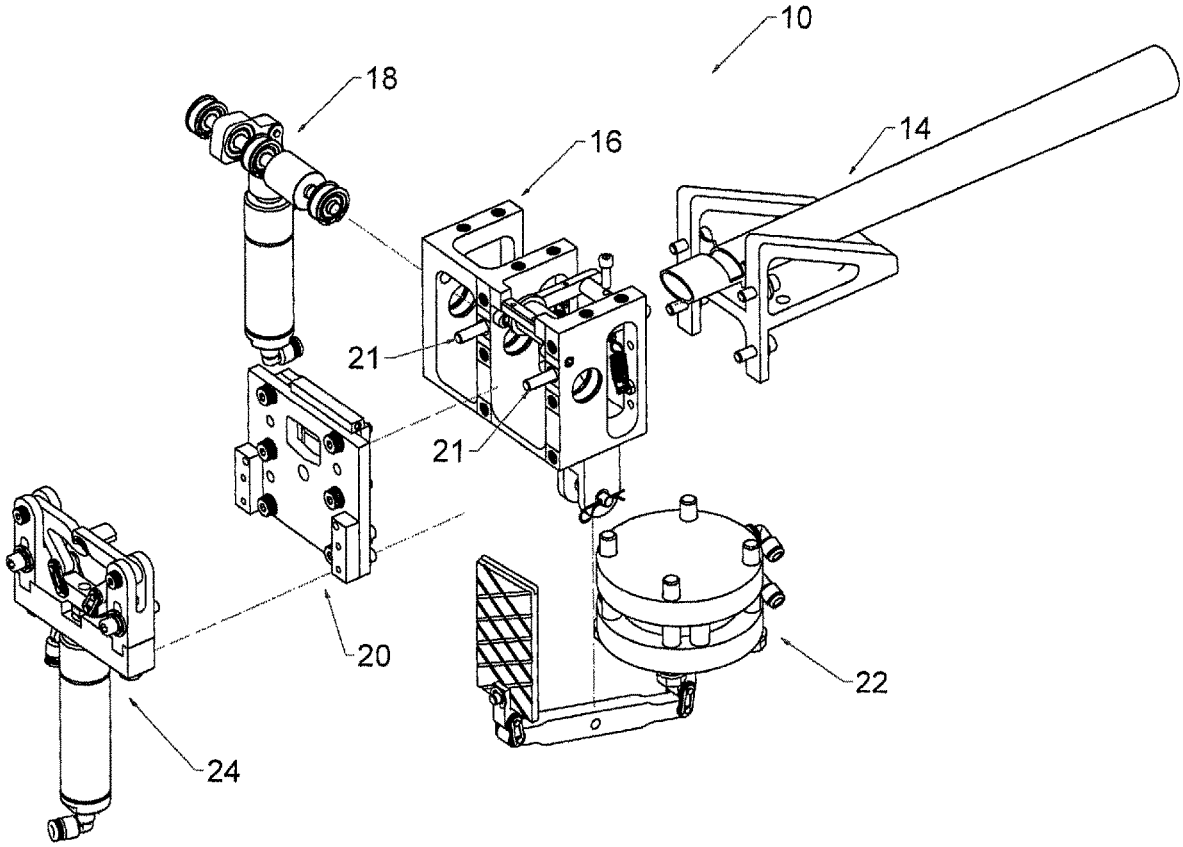

Referring now to the drawings, and in particular to FIGS. 1A and 1B, it can be seen that a banding machine is designated generally by the numeral 10. The banding machine is substantially enclosed within a housing 12 which has an opening 13. A control system is also associated with the banding machine so as to sequence its operations. The control system, which will be discussed in detail later, may provide for a "manual mode" to set up and initially start the operation of the machine and an "auto mode" wherein the machine continuously operates to cut an elastomeric tube to a specific length whereupon the band is expanded for placement over an object, as discussed above. The control system also allows for the machine to operate at selected speeds to accommodate the operator's skill level. In any event, the housing 12 is employed to protect the components of the banding machine and permit only a selected portion of the machine to extend upwardly and outwardly from an opening provided in the housing. The housing prevents debris from entering into the machine and also serves a safety function to keep hands and fingers away from the operating mechanisms contained within the banding machine. Additionally, the housing's opening 13—from which a stretcher assembly that expands the cut band extends—is positioned so that the object to be banded may be placed or inserted to any position or depth with respect to the expanded band.

The machine 10 includes the following major components. A tube guide assembly generally designated by the numeral 14 receives a polymeric and/or elastomeric tube which is cut to length whereupon the cut band is placed on an object as will be discussed. A frame assembly, designated generally by the numeral 16, is associated with the tube guide assembly 14 and supports it and other components to facilitate positioning of the elastomeric tube prior to, during, and after the cutting operation. A drive assembly, designated generally by the numeral 18, is associated with the frame assembly 16 and functions to direct the elastomeric tube through the frame assembly in preparation for a cutting operation. A knife guide assembly 20 is also coupled to the frame assembly 16 and assists with positioning of the tube prior to cutting. A pair of dowel pins 21 may extend from the frame assembly 16 to assist in its alignment and assembly to the knife guide assembly 20. Moreover, the knife guide assembly assists with the cutting operation and further transfer of the cut tube for further processing. A cutter assembly, which is designated generally by the numeral 22, is mounted to the tube guide assembly 14 and is in operative relationship with the knife guide assembly 20 so as to perform the cutting operation. A stretcher assembly, designated generally by the numeral 24, receives a cut band from the knife guide assembly 20, moves the cut band through the housing's opening 13, and stretches the band outside of the housing 12 to allow receipt of an object. Once the cut band is received on the object; the object, with the band installed, is directed away from the stretcher assembly by an operator and then the control system automatically retracts the stretcher assembly into the housing to receive another cut band.

Figure 2A:
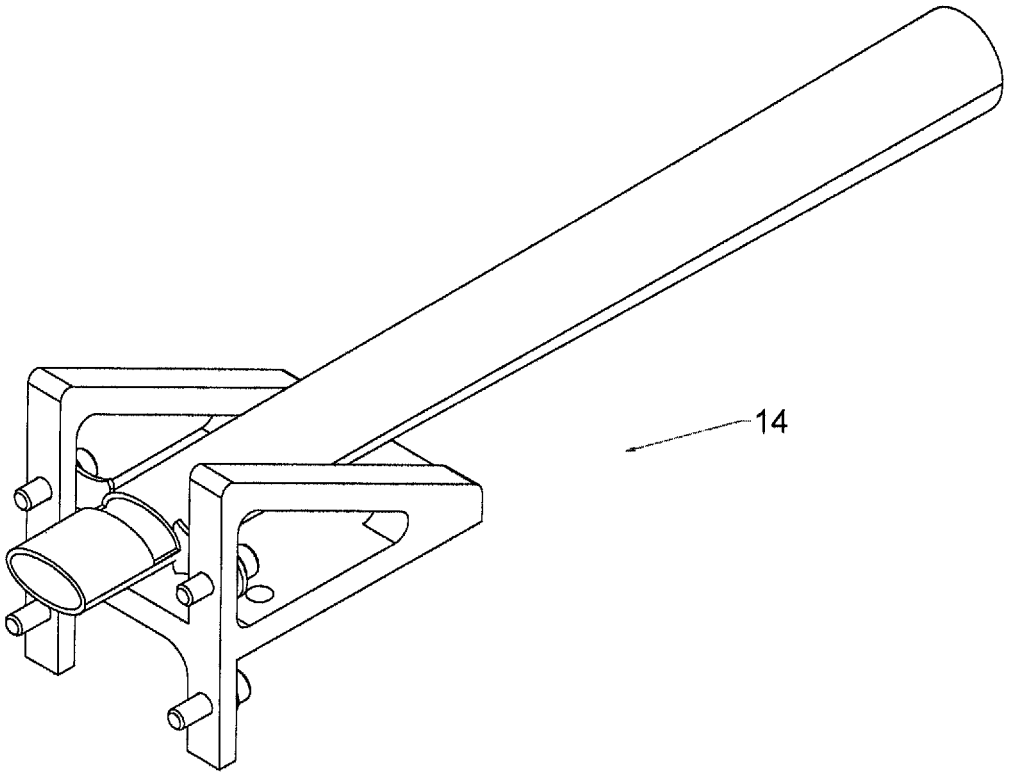
FIG. 2A is a perspective view of a tube guide assembly utilized in the banding machine and FIG. 2B is an exploded perspective view of the tube guide assembly according to the concepts of the present invention.
Figure 2B:
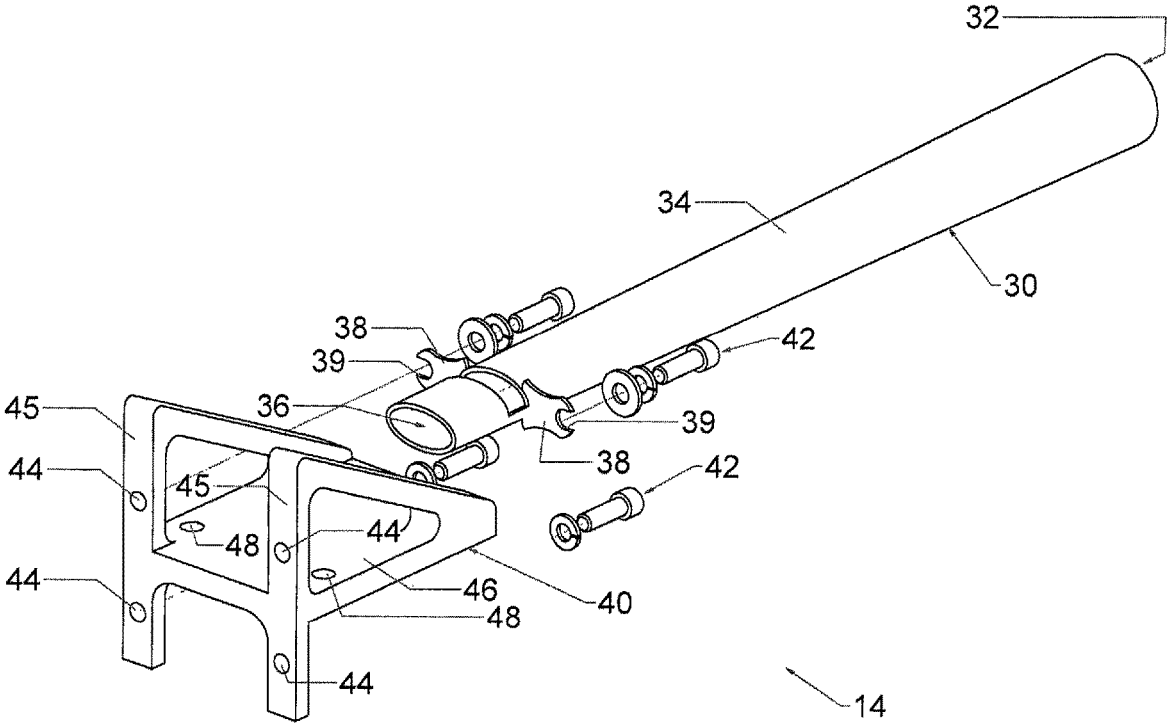

Referring now to FIGS. 2A and 2B, it can be seen that the tube guide assembly 14 includes a tube guide 30 which receives an elastomeric tube of a predetermined diameter into an entry end 32. The tube guide 30 may be of a tubular construction but in some embodiments a taper portion 34 may be provided. Whether a taper portion or a tubular portion is provided, an exit end 36 is provided opposite the entry end 32. If provided, the taper portion 34 effectively flattens the elastomeric tube prior to the cutting operation. In some embodiments, the exit end 36 may be elliptical in shape. In other embodiments, the exit end 36 may be oval, circular, or any other shape suitable for the elastomeric tube material, length, and/or the cutting operation. In some embodiments, the tube guide 30 may be provided with radially extending tube flanges 38 which are positioned slightly away from the exit end 36. In some embodiments, each flange 38 may be provided with an open-ended slot 39.

A mount frame 40 is provided so that the tube guide 30 may be mounted thereon by fasteners 42. In particular, the fasteners 42 are received in respective slots 39 provided by the tube flange 38 into openings 44 provided by vertical bars 45 of the structure of the mount frame 40. The fasteners 42 and corresponding lock washers may be further used to secure the tube guide assembly 14 to the frame assembly 16. The slots 39 are advantageous in that they allow for easy replacement of the tube guide by loosening the fasteners instead of full withdrawal of the fasteners that would be required if a through hole were used instead of a slot. The mount frame 40 also has a substantially horizontal plate 46 extending from the vertical bars 45, wherein the mount plate 46 has mount holes 48 which receive fasteners to secure the cutter assembly 22 to the tube guide assembly 14.

Figure 3A:
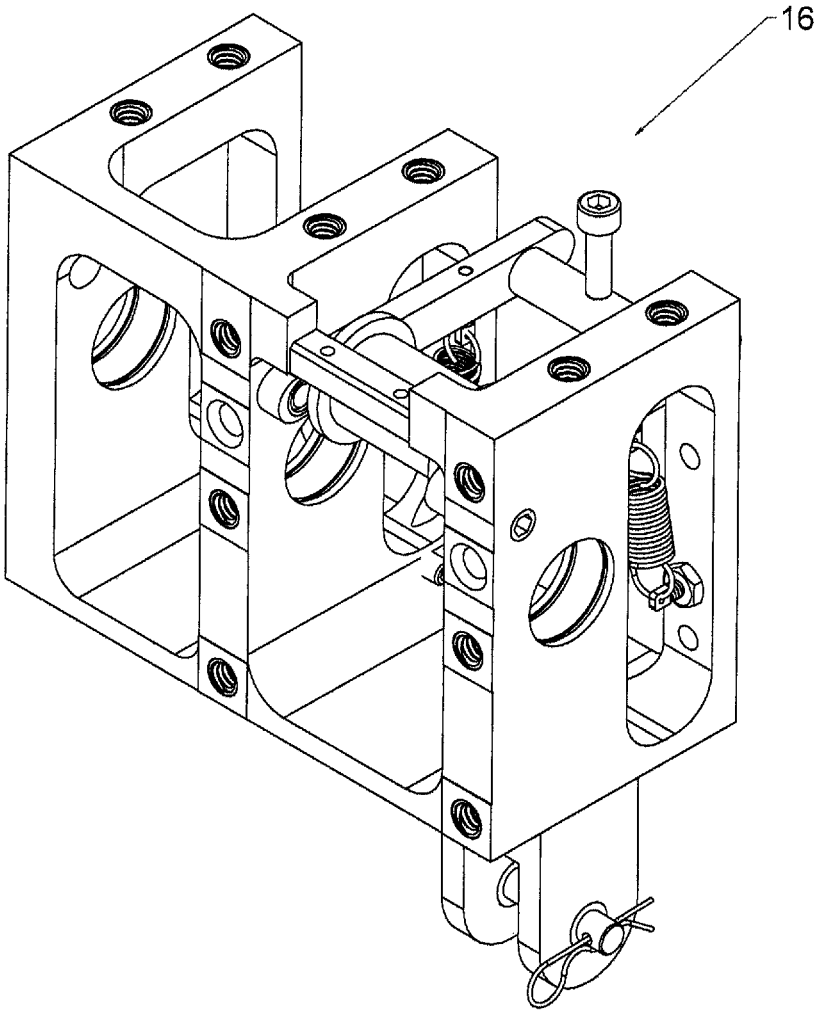
FIG. 3A is a perspective view of a frame assembly utilized in the banding machine and FIG. 3B is an exploded perspective view of the frame assembly according to the concepts of the present invention.
Figure 3B:
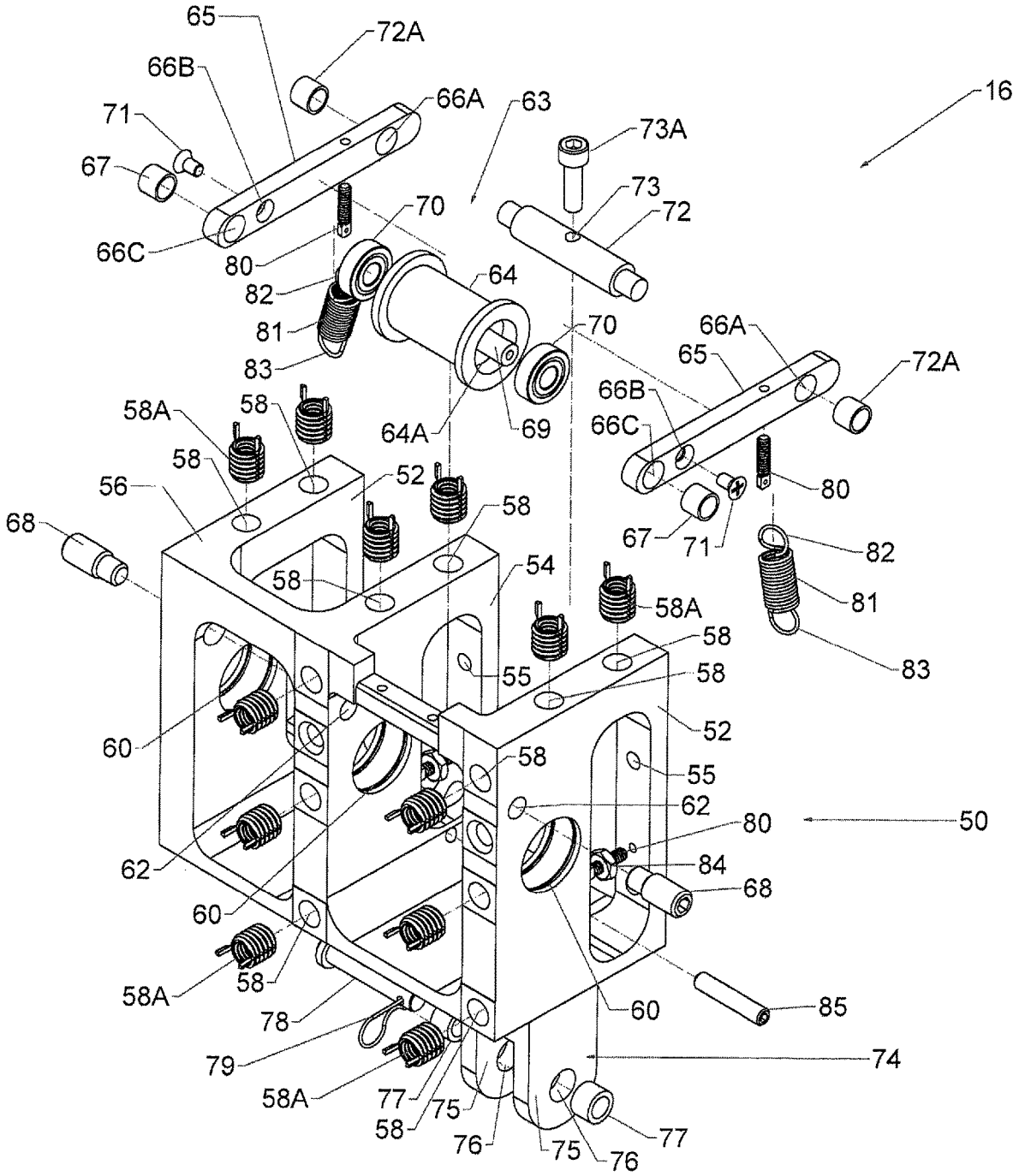

Referring now to FIGS. 3A and 3B, it can be seen that the frame assembly 16 includes a frame body 50. The frame body 50 provides two external ribs 52 which are provided at each side of the body. An internal rib 54 may also extend from the frame body and is in a substantially parallel relationship with the external ribs 52. Rear sections of the internal rib 54 and at least one of the external ribs 52 may have threaded mount openings 55 therethrough to receive the fasteners 42 to secure the frame assembly 16 to the tube guide assembly 14. A brace bar 56 may be provided so as to connect the ribs 52 and 54 to one another and to provide stability to the body 50. The frame body 50 and its associated external ribs 52, the internal rib 54 and other surfaces may have openings 58 therein which receive screw locking helical fasteners 58A. The openings 58 receive threaded fasteners to attach other structural components of the machine 10 to the frame body 50. The helical fasteners 58A may be used to prevent galling or friction wear between the threaded fastener and the opening 58. Extending through each of the ribs 52 and 54 is a drive bearing hole 60 which receives the drive assembly 18, the operation of which will be discussed in detail later.

The internal rib 54 and at least one of the external ribs 52 may provide aligned idler roller openings 62. These slots are aligned so as to receive an idler roller assembly designated generally by the numeral 63. The idler roller assembly 63 includes an idler roller 64. The idler roller 64 may be smooth and have a linear profile as shown in the drawing. However, other embodiments may provide for an idler roller with a surface that may be knurled and/or which may provide a convex or concave profile. The surface of the roller is dependent upon the material being fed through the banding machine wherein the particular surface and profile is selected for those best suited for the particular material and its cooperation with other components in the machine. In any event, the idler roller 64 has a roller hole 64A extending axially therethrough. A pair of opposed idler arms 65 carry the idler roller 64 therebetween. Each idler arm 65 has opposed tensioning holes 66A, roller holes 66B, and pivot holes 66C that are aligned with one another. Received within each pivot hole 66C is a pivot bushing 67 wherein the idler arms 65 are assembled to the frame body 50 by insertion of bushing pins 68 through the idler roller openings 62 such that a portion of the bushing pin 68 is received in the corresponding pivot bushing 67. As will become apparent as the description proceeds, the idler arms 65 are pivotable at the pivot holes 66C so as to exert a desired amount of force on the elastomeric tube as it is advanced through the frame assembly 16.

Received within the roller hole 66B is an idler rod 69 which is rotatably supported by idler bearings 70 wherein the bearings are positioned between an outer diameter of the idler rod 69 and the inner diameter of the roller hole 64A on both ends of the idler roller 64. Idler fasteners 71 are received in the roller holes 66B of the idler arms 65 and each end of the idler rod 69 so as to rotatably secure the idler roller 64 between the idler arms 65. Accordingly, as will be explained in further detail, the idler roller 64 rotates as the elastomeric tube passes underneath.

Connected between the idler arms 65 at their respective tensioning holes 66A is a tensioning rod 72. Bushings 72A are received at each end of the tensioning rod 72 and in the tensioning holes 66A. The tensioning rod 72 provides for a cross hole 73 which receives an adjustment screw 73A. Interposed between the head of the adjustment screw 73A and the tensioning rod 72 is the housing 12, as best seen in FIG. 1A. As will be described in detail later, rotational adjustment of the adjustment screw 73A results in adjustment of the amount of force exerted by the idler roller assembly 63 and, in particular, the idler roller 64, as the elastomeric tube passes between the idler roller and a roller provided by the drive assembly 18 as will be described.

Accordingly, as will be appreciated as the description proceeds, varying thicknesses of the elastomeric tube may be accommodated by positionally adjusting the idler roller assembly 63 via the adjustment screw 73A.

A further adjustment to control passage of the tube may be made by coupling tensioning springs between the idler roller assembly 63 and the frame body 50. Each idler arm 65 may have attached to its underside a spring anchor 80 at a position away from the pivot holes 66C. The spring anchor 80 provides for an eyelet to which is connected a tensioner spring 81. The spring may have an anchor end 82, which may be coupled to the eyelet of the anchor end, opposite a frame end 83. A jam nut 84 is received in a corresponding rib 52 or rib 54 so as to secure the frame ends 83 to the frame body. Skilled artisans will appreciate that the tensioning springs assist in exerting a slight or controlled compressive force on the idler roller 64 to coact with a drive wheel 150 of the drive assembly 18 to advance the elastomeric tube as will be discussed.

Extending downwardly from the frame body 50 and in a direction opposite one of the external ribs 52 is a clevis 74. The clevis 74 provides for opposed clevis tabs 75 which extend away from the ribs. In the embodiment shown, the tabs extend from the external rib 52 provided with the idler roller opening 62. Extending through the tabs 75 are aligned clevis holes 76. Each clevis hole 76 receives a clevis bushing 77 which may be configured to receive a clevis pin 78. The pin has a head at one end and a through hole at an opposite end to receive a bow tie cotter pin 79. The clevis 74 and the clevis pin 78 are used to facilitate operation of the cutter assembly 22 as will be discussed.

A set screw 85 is shown in FIG. 3B and extends through the internal rib 54. The set screw 85 is used to secure the stroke length of the drive assembly 18 as will be described below.

Figure 4A:
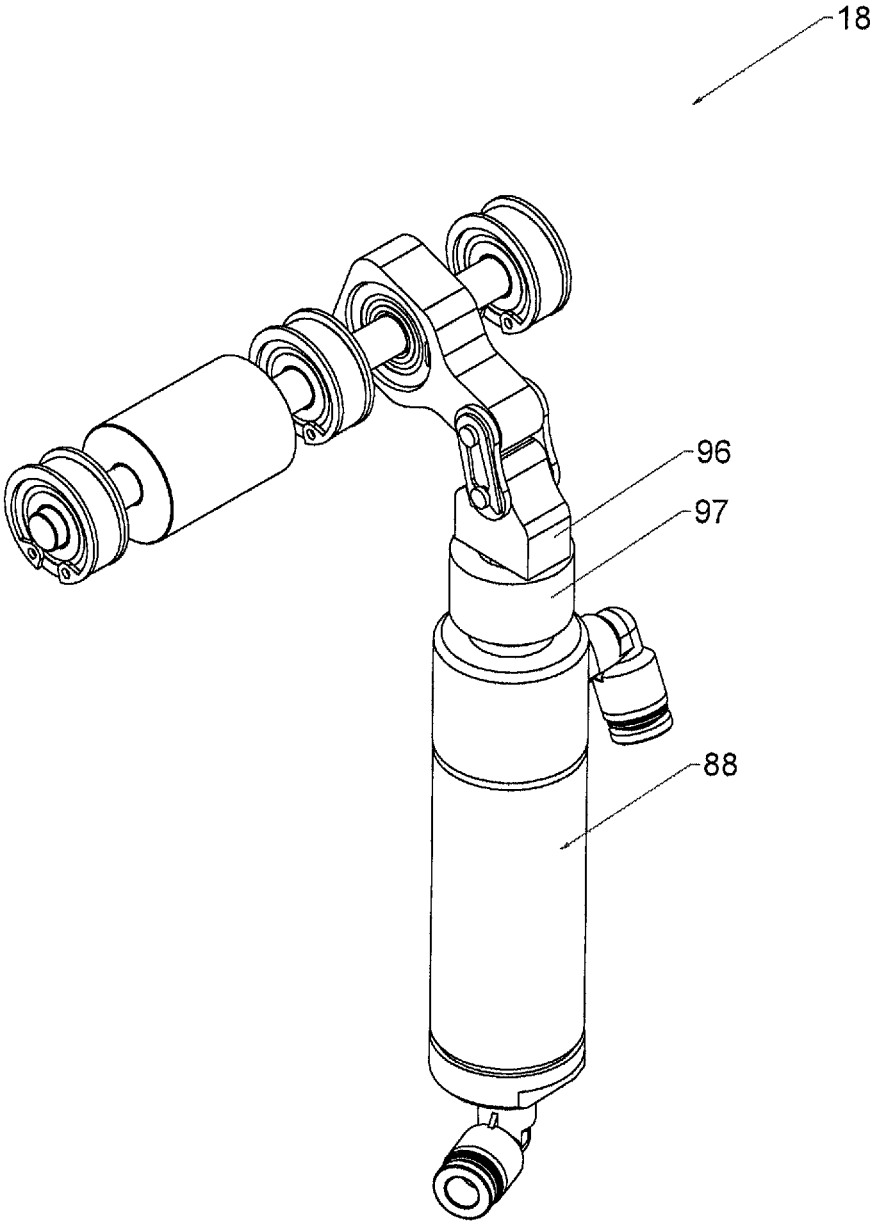
FIG. 4A is a perspective view of a drive assembly utilized in the banding machine and FIG. 4B is an exploded perspective view of the drive assembly according to the concepts of the present invention.
Figure 4B:
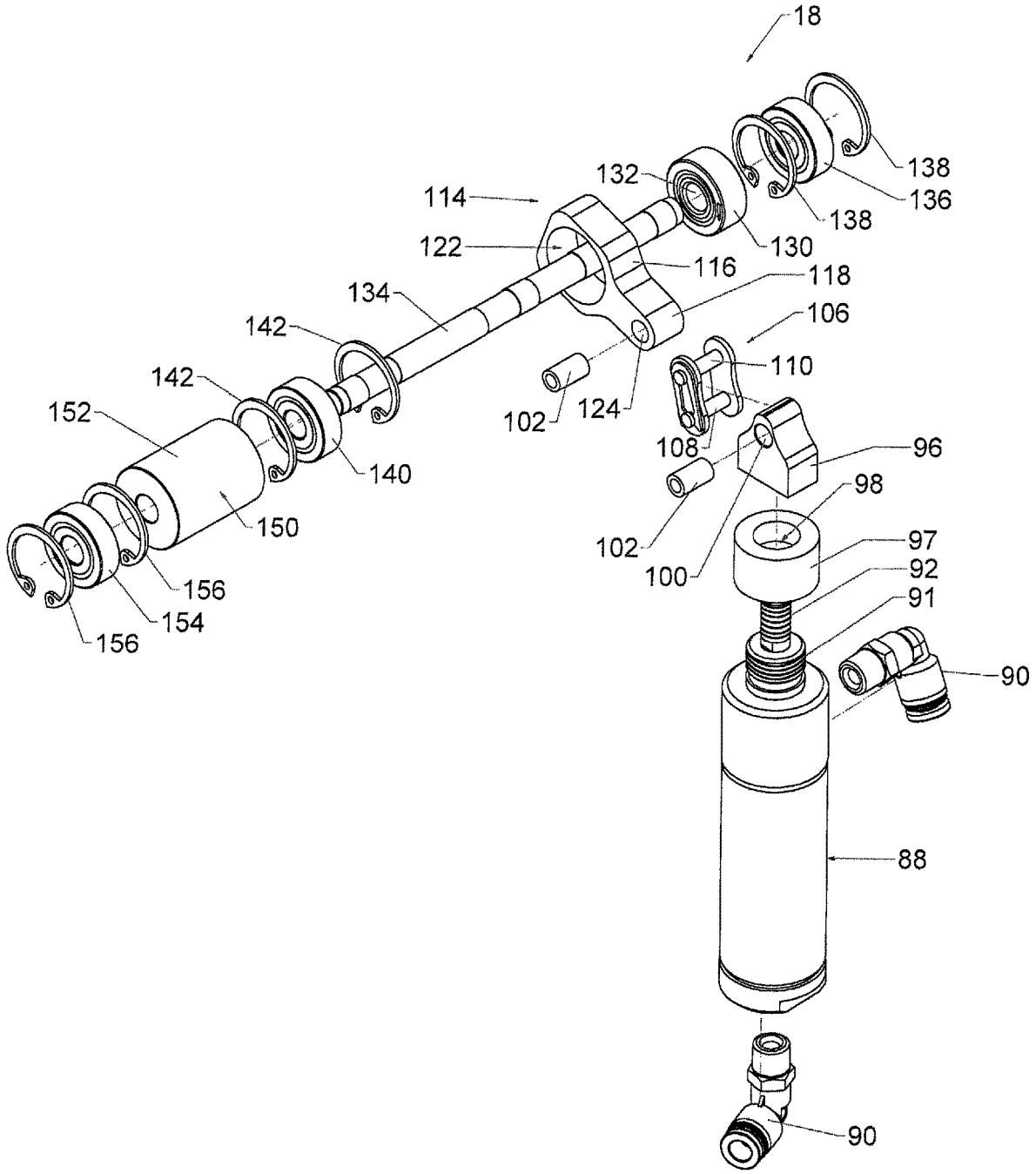

Referring now to FIGS. 4A and 4B, it can be seen that the drive assembly is designated generally by the numeral 18. The drive assembly 18 includes an air cylinder 88 which has air ports 90. Extending from the cylinder 88 is a threaded collar 91 from which extends a threaded piston 92 wherein flow of pressurized air into one of the ports 90 extends the piston 92 in an axial direction and wherein entry of air into the other port 90 retracts the piston in an opposite direction. The piston 92 may provide a threaded end which may be connected to an underside of a feed arm clevis 96. An internally threaded adjustment collar 97, which has a collar opening 98 extending therethrough, may be positioned between the clevis and the drive piston 92 and mated with the threaded collar 91. The piston 92 extends and retracts through the collar opening 98. Skilled artisans will appreciate that rotation of the collar 97 adjusts the effective stroke length of the piston 92, which in turn adjusts the feed length of the elastomeric tube as will be discussed. The clevis 96 may provide a transverse clevis hole 100 extending therethrough which receives a sleeve bearing 102. A roller chain link 106 is connected to the feed arm clevis 96. In particular, the chain link 106 provides for a clevis link 108 which is received within the sleeve bearing 102 that is received in the clevis hole 100 such that the roller chain link 106 moves as does the feed arm clevis 96 and the attached piston 92. The roller chain link 106 also provides for a feed arm link 110 which is connected to a feed arm 114.

The feed arm 114 includes a member 116 with a radially extending finger 118. A sleeve bearing 102 rotatably receives the feed arm link 110 wherein the sleeve bearing 102 is received in a finger hole 124 extending through the finger 118. The member 116 also includes a clutch hole 122 extending therethrough which receives a one-way bearing clutch 130. The one-way bearing clutch 130 provides for a bearing hole 132 extending therethrough. Received through the bearing hole 132 is a drive shaft 134. Also secured to the drive shaft is an external rib bearing 136 wherein retaining rings 138 are employed to maintain the position of the external rib bearing 136 on the drive shaft. In a similar manner, an internal rib bearing 140 is secured to the drive shaft and retained by retaining rings 142. A drive wheel 150 is secured to the drive shaft 134 and may provide for a knurled surface 152. In some embodiments the surface 152 may be smooth. And in some embodiments the profile of the surface 152 may be linear, convex, concave, or configured to ensure repeatable movement of the elastomeric tube. Skilled artisans will appreciate that the drive wheel 150 rotates with the drive shaft as it is rotated. An external rib bearing 154 is provided on the end of the drive shaft and is maintained in position by retaining rings 156.

The one-way bearing clutch 130 is configured to be held by the member 116 which is operatively connected to the air cylinder 88. Accordingly, as the piston 92 is moved axially, the feed arm clevis 96 and the roller chain link 106 are moved upwardly so as to slightly rotate the member 116. The clutch, which has an internal race that is secured to the drive shaft 134, functions to rotate the drive shaft in a counter-clockwise direction as shown in the drawing. The bearings 136, 140, and 154 are maintained within the respective drive bearing holes 60 maintained by the corresponding ribs 52 and 54 of the frame body 50. As such, the drive shaft is incrementally rotated which in turn incrementally rotates the drive wheel 150. The drive wheel 150 is positionally aligned with the idler roller 64 of the idler roller assembly 63. Accordingly, as the elastomer tube is fed through the tube guide assembly, it is received in between the idler roller 64 and the drive wheel 150.

In operation, the up/down motion of the piston 92 incrementally rotates the drive wheel 150 which grips the elastomeric tube and together with the idler roller 64 functions to incrementally advance the elastomeric tube through the frame assembly 16 for positioning into the knife guide assembly 20. The length of the tube extending from the frame assembly 16 is controlled by the amount of rotation of the drive wheel. Skilled artisans will appreciate that the length of the cut band may be adjusted as needed. This adjustment may be implemented by rotating the adjustment collar 97 which in turn adjusts the stroke length of the drive piston 92, which in turn adjusts the rotation of the drive wheel 150. The set screw 85 (shown in FIG. 3B) extends through the internal rib 54 and engages the outer surface of the adjustment collar 97 to hold it in place and, in turn, maintains a consistent stroke length of the drive piston. In any event, the cutter assembly 22 then functions to cut the elastomeric tube into a band. The downward motion of the piston 92 does not reverse rotation of the drive shaft in view of the one-way clutch bearing 130. As a result, the elastomeric tube remains in position until the next axial movement of the piston.

Figure 5A:
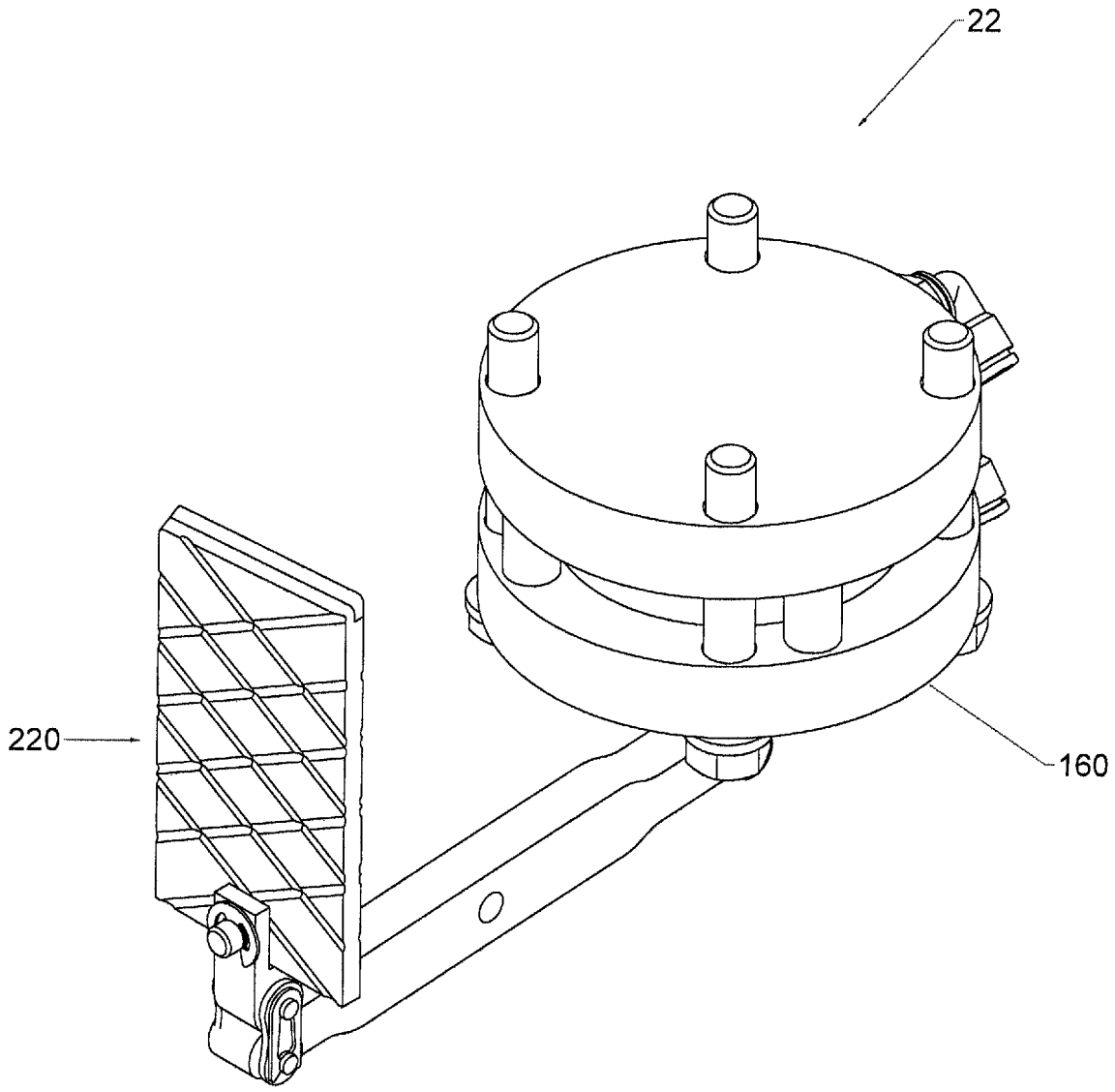
FIG. 5A is a perspective view of a cutter assembly utilized in the banding machine and FIG. 5B is an exploded perspective view of the cutter assembly according to the concepts of the present invention.
Figure 5B:
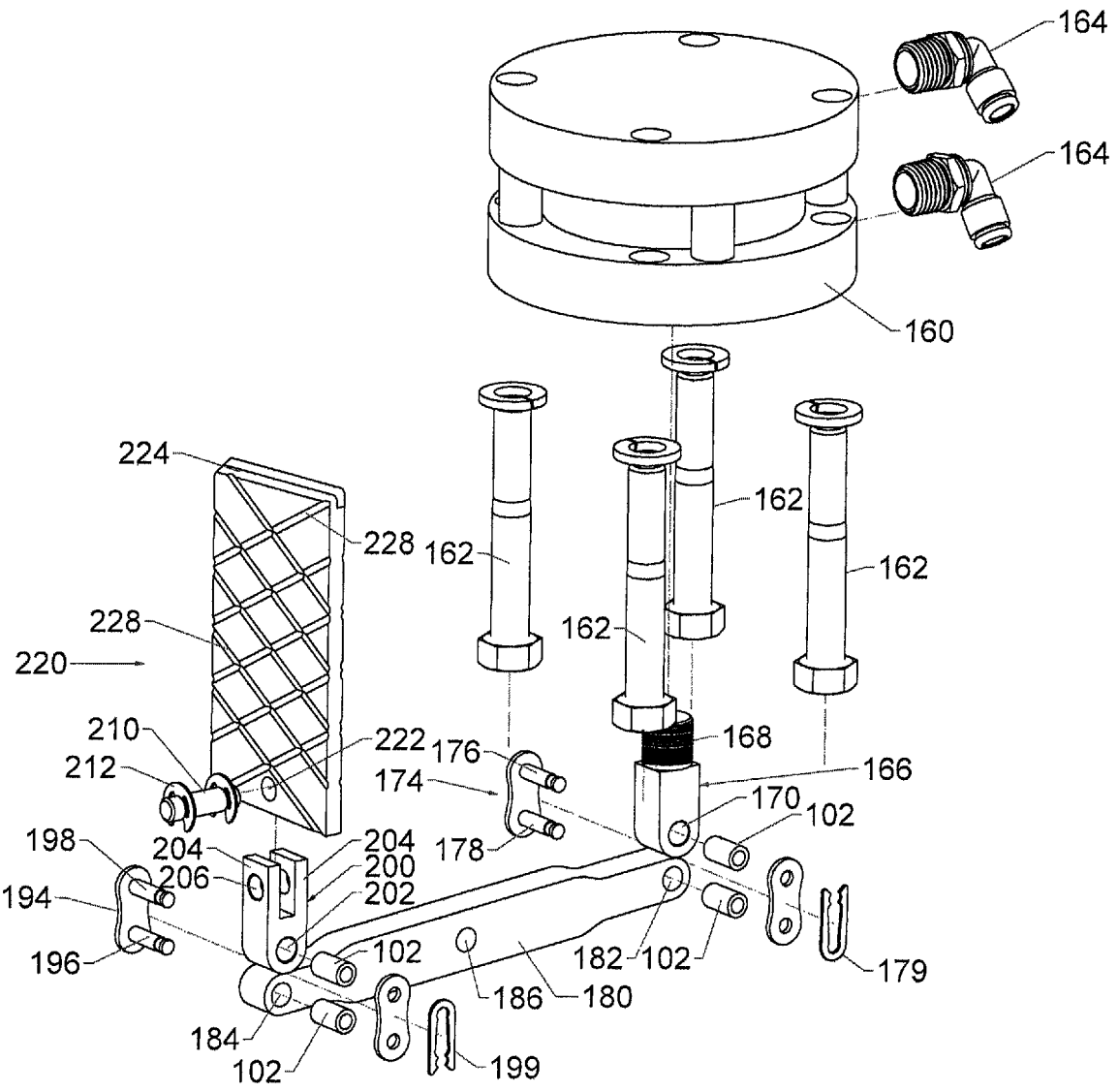

Referring now to FIGS. 5A and 5B, it can be seen that the cutter arm assembly is designated generally by the numeral 22. The assembly 22 includes a tie rod air cylinder 160 which has openings about the periphery thereof so as to receive mounting bolts 162 that are received in openings 48 of the tube guide assembly 14 to secure the cylinder 160 to an underside of the mount frame 40. The cylinder 160 includes two air ports 164 which receive pressurized air. A knife clevis 166 is connected to the air cylinder 160. The clevis 166 includes a threaded end 168 which is received in or connected to a piston (not shown) associated with the cylinder 160. The pressurized air delivered to the cylinder results in the knife clevis 166 moving in an up/down axial direction. The clevis 166 includes a clevis hole 170 extending therethrough which receives a sleeve bearing 102.

A cylinder chain 174 is connected to the clevis 166. In particular, the cylinder chain includes a clevis link 176 and a rocker arm link 178. The clevis link 176 is received through the clevis hole 170 with a sleeve bearing 102 received therebetween and moves with the knife clevis 166 in a corresponding fashion. A corresponding chain and clip 179 holds the chain together.

A rocker arm 180 is connected to the cylinder chain 174. The rocker arm includes a cylinder end hole 182 extending therethrough at one end and a knife end hole 184 extending therethrough at an opposite end. The rocker arm link 178 is received in a sleeve bearing 102 that is received in the cylinder end hole 182 so as to connect the clevis 166 to the rocker arm 180. The rocker arm 180 also provides a pivot hole 186 extending therethrough which is at substantially a midpoint of the arm, wherein the hole 186 aligns with the clevis holes 76 of the frame body 50. In one embodiment, as shown in FIGS. 1A and 1B, the rocker arm 180 is received in between the clevis tabs 75. The clevis pin 78 is received through the clevis holes 76 and the pivot hole 186. The bow-tie cotter pin 79, which may also be referred to as a retention clip holds the clevis pin 78 in place so that the rocker arm 180 is pivotably captured between the clevis tabs 75.

A knife chain 194 is associated with the knife end hole 184. In particular, the knife chain 194 provides a rocker arm link 196 and a knife link 198. The rocker arm link 196, along with a sleeve bearing 102, is received in the knife end hole 184. A corresponding chain and clip 199 holds the chain together.

A knife clevis 200 includes a clevis hole 202 extending therethrough that is attached to the knife link 198. In particular, the knife link 198 is received through the clevis hole 202 with a sleeve bearing 102 interposed therebetween. The knife clevis 200 includes a pair of clevis tabs 204 which provide for tab holes 206 aligned with one another and extending therethrough. A headless clevis pin 210 is receivable through the tab holes 206 and maintained in place by retaining clips 212 maintained at each end of the pin 210.

A knife blade 220 is associated with the knife clevis 200. The knife blade 220 in the present embodiment is constructed from a stainless steel material although other hardened materials may be used. The knife blade may include at least one attachment hole 222 extending therethrough at each end thereof. The knife blade may also provide a sharp edge 224 which is used to cut the elastomeric tubing as will be described. In the present embodiment, the knife blade 220 may provide a taper edge 224 to facilitate cutting of the elastomeric material. In some embodiments, the knife blade 220 may provide a sharp taper edge at both ends. Skilled artisans will further appreciate that the knife blade has a predetermined thickness.

The knife blade 220 may be secured in different orientations by reorienting the blade in the knife clevis. As a result, when the taper edge 224 becomes dull, the blade can be reoriented to use an unused sharp edge. The knife blade 220 is coupled to the knife clevis 200. In particular, the knife clevis 200 is connected to the knife link 198 with a sleeve bearing 102 interposed therebetween. The knife blade 220 is received between the clevis tabs 204 and the clevis pin 210 extends through the tab holes 206 and the attachment hole 222 to secure the knife clevis 200 to the knife blade 220. Skilled artisans will appreciate that the geometry, shape, and material of the knife blade 220 may change depending upon the material to be cut and other end use considerations. In some embodiments, one or both surfaces of the knife blade 220 may provide lubrication grooves 228. These grooves allow a lubricant to flow between the knife blade 220 and the knife guide assembly 20 as will be discussed further below.

In operation, the air cylinder 160 upon receiving pressurized air directs the knife clevis 166 downwardly. This causes the pivot of the rocker arm 180 at the pivot hole 186. This in turn directs the knife end of the rocker arm 180 upwardly which, in turn, forces the knife blade 220 into the knife guide assembly 20 so as to perform a cutting operation. When the cutting operation is complete, the clevis moves in the opposite direction and the knife blade is withdrawn.

Figure 6A:
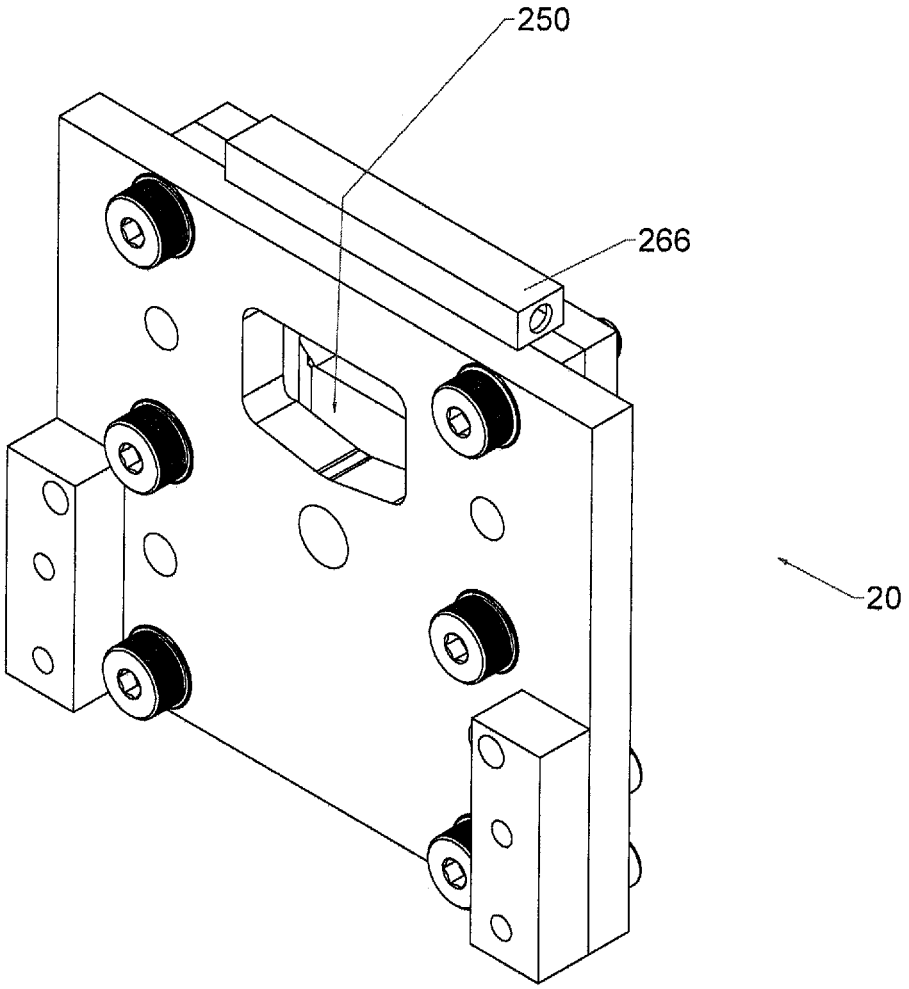
FIG. 6A is a perspective view of a knife guide assembly utilized in the banding machine and FIG. 6B is an exploded perspective view of the knife guide assembly according to the concepts of the present invention.
Figure 6B:
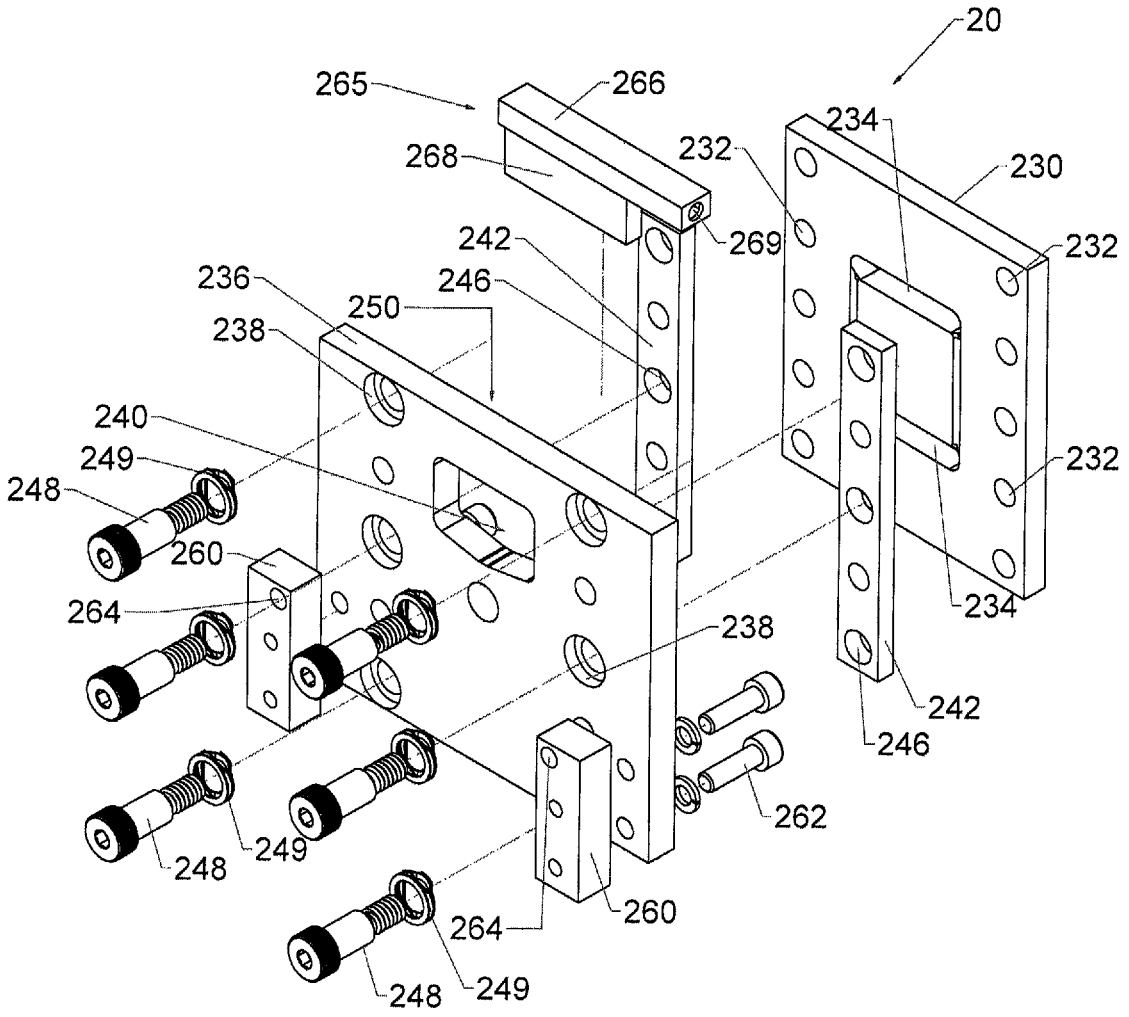

Referring now to FIGS. 6A and 6B, it can be seen that the knife guide assembly is designated generally by the numeral 20. The knife guide assembly 20 is secured to the frame assembly 16 and is in an operative relationship with both the knife blade 220 and the frame assembly. The assembly 20 includes an anvil plate 230 which has a plurality of fastener holes 232 therethrough arranged on opposite edges thereof. Extending through the anvil plate 230 is also at least one feed slot 234 which is aligned to receive the extended length of tubing. In the embodiment shown, the anvil plate 230 may be provided with two feed slots 234. Skilled artisans will appreciate that the anvil plate 230 may be made of the same hardened material as the knife blade 220. Moreover, the edges of the plate 230 that form the slots may be provided with sharpened edges. Connected to the anvil plate 230 is a knife guard 236 which provides a plurality of countersink fastener holes 238 therethrough which are aligned with the corresponding fastener holes 232 of the anvil plate 230. The knife guard 236 provides for a band window 240 which is aligned with the feed slot 234. Skilled artisans will appreciate that the band window 240 is slightly larger than the feed slot 234 as the band window will be receiving a cut band and transferring it through the window 240 for receipt by the stretcher assembly 24 as will be discussed.

Interposed between the anvil plate 230 and the knife guard 236 are a pair of spacer plates 242 which have plate holes 246 extending therethrough, wherein the plate holes 246 are aligned with the fastener holes 232 of the anvil plate 230 and the fastener holes 238 of the knife guard 236. Fasteners 248 are received through the fastener holes 232, 238 and plate holes 246 so as to attach the anvil plate, knife guard, and spacers to one another and also to the frame body 50 of the frame assembly 16. Each fastener 248 may have a spring washer 249 associated therewith, wherein each spring washer 249 is received and retained in the corresponding countersink of fastener holes 238. A pair of edge spacer plates 260 may be secured with a corresponding pair of fasteners 262 to vertical edges of the knife guard 236. Each spacer plate may provide a mounting hole 264.

The spacer plates 242 connected to the anvil plate 230 and the knife guard 236 form a knife gap 250 therebetween. In the present embodiment the spacer plates 242 may be machined to a thickness dimensionally less than the thickness of the knife blade 220. The knife gap 250 is sized to slidably receive the knife blade 220 as it moves in a cutting motion. Insertion of the spring washers 249 in the countersink of the fastener holes 238 allows for the fasteners 248 to be tightened so that a sufficient amount of clearance may be maintained in the knife gap 250 to facilitate repeated cutting movements of the knife blade therein. In any event, the motion of the sharpened edges of the knife blade 220 against the sharpened edges of the aligned slots 234 that receive the elastomeric tube results in a scissor-like action that cuts the tube into a band. The anvil plate 230 may be reversible and rotatable so that when one of the sharpened edges becomes worn, reorientation of the plate extends the useful life of the plate. Skilled artisans will also appreciate that rotation of the anvil plate 230 to associate the unused feed slot 234 into alignment with the tube extending from idler roller 64 and the drive wheel 150 also extends the useful life of the anvil plate.

A lubrication system 265 may be associated with the knife guide assembly 20. The system 265 provides an insert 266 which may be positioned at the top of the knife guard 236. The insert may provide a tab 268 which partially extends into the knife gap 250. The insert 266 has a nozzle 269 which receives lubricant which passes through the tab into the knife gap and into the lubrication grooves 228 to facilitate operation of the knife in the knife guide assembly.

Figure 7A:
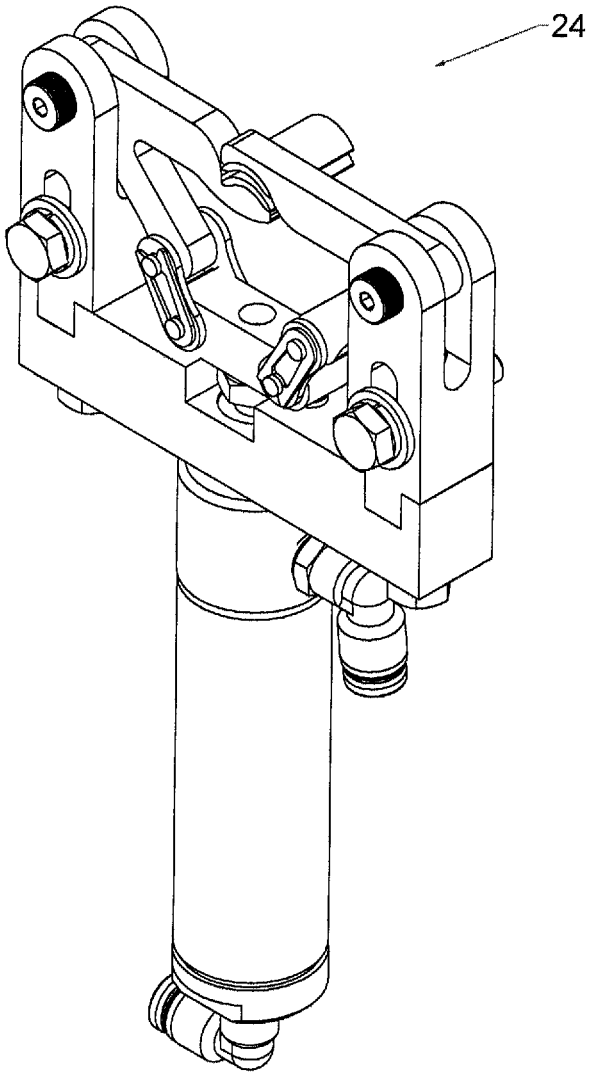
FIG. 7A is a perspective view of a stretcher assembly used in the banding machine and FIG. 7B is an exploded perspective view of the stretcher assembly according to the concepts of the present invention.
Figure 7B:
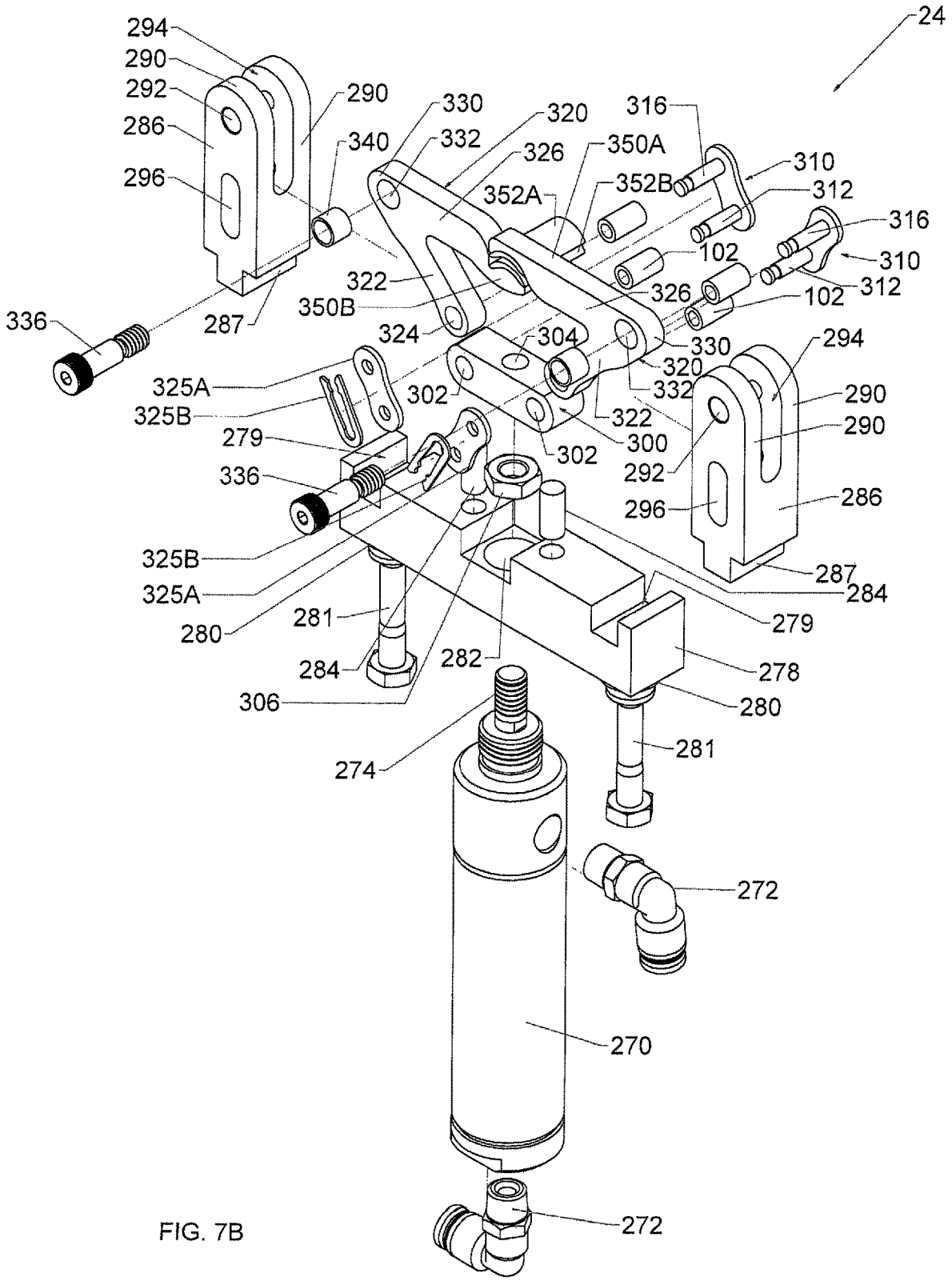

Referring now to FIGS. 7A and 7B, it can be seen that the stretcher assembly is designated generally by the numeral 24. The stretcher assembly includes a stretcher air cylinder 270 which has a pair of air ports with fittings 272 which receive pressurized air for operation thereof. Extending axially from the air cylinder 270 is a piston 274 which moves in an up/down motion. In some embodiments the piston may be provided with a threaded end 274.

A top plate 278 provides frame holes 280 at each end thereof. The plate provides a pair of cross-slots 279 which intersect with a corresponding frame hole 280. Also extending through the top plate 278 is a piston hole 282 which is positioned at about a midpoint of the top plate and which slidably receives the piston 274. A pair of rubber cushions 284 may extend upwardly from a top surface of the top plate 278 on either side of the piston hole 282.

A pair of side frames 286 are attached to the top plate 278 by fasteners 281 that extend through the frame holes 280. Each side frame 286 has a footer 287 that is received in a corresponding cross-slot 279. Each side frame 286 includes a pair of opposed frame arms 290 which have aligned arm holes 292 extending therethrough. The arms 290 form a frame gap 294 therebetween. Each side frame may have a mounting slot 296 extending therethrough which is aligned with the mount holes 264 provided by the knife guide assembly 20. Fasteners 298 (seen in FIG. 1A) are employed to secure the stretcher assembly to the knife guide assembly 20.

A stretcher center linkage 300 is associated with the piston 274 as will be described. The linkage 300 includes a pair of link holes 302 which transversely extend therethrough. The stretcher center linkage 300 also includes a piston hole 304 which may be internally threaded and which is attached to the piston 274. Accordingly, the up and down movement of the piston 274 results in corresponding up and down movement of the linkage 300. A nut 306 may be employed to positionally adjust the center linkage 300 with respect to the piston 274.

A pair of stretcher chains 310 is connected to the corresponding link holes 302 of the linkage 300. The chains 310 include a center link 312 and a stretcher arm link 316. Each of the links receives a sleeve bearing 102. The center links 312 are received in corresponding link holes 302.

The stretcher assembly 24 includes a pair of stretcher arms 320 which are coupled to corresponding side frames 286 and also the stretcher center linkage 300 via the stretcher arm links 316. Each stretcher arm includes a strut 322 which has a strut hole 324 that receives a corresponding stretcher arm link 316 of the stretcher chain 310. The links 312 and 316 are coupled to one another by a corresponding chain 325A and clip 325B. Sleeve bearings 102 are interposed between the link 316 and the hole 324 so as to allow for pivotable movement thereof. Accordingly, the corresponding chains 325A and clips 325B and the associated chains 310 couple the center linkage 300 to the respective stretcher arms 320. Extending from the strut 322 is a branch 326 wherein an elbow 330 connects the strut 322 to the branch 326. Skilled artisans will appreciate that the strut 322 and the branch 326 are at acute angles to one another, wherein the angle may be less than 85° and greater than 10°. For reasons that will be discussed later, each stretcher arm will have a slightly different angle so as to facilitate their movement with respect to each other. The elbow 330 provides for an elbow hole 332 extending therethrough. The elbow 330 is sized to fit within the frame gap 294 of a corresponding arm 290. Indeed, the elbow holes 332 are aligned with the arm holes 292 so as to receive a sleeve bearing 340 and the corresponding bolt 336 which maintains each stretcher arm between corresponding frame arms 290. Skilled artisans will appreciate that the sleeve bearing 340 may be constructed of a plastic material so as to allow for pivotable movement of the stretcher arms with respect to the frame arms 290.

Extending from each branch 326 is a stretcher beam 350 wherein one stretcher arm provides for a stretcher beam 350A and the other stretcher arm 320 provides for a stretcher beam 350B. The stretcher beams 350 are configured to mate or mesh with one another so as to provide for a reduced profile. Extending transversely from each stretcher beam is a stretcher finger 352A and 352B. Skilled artisans will further appreciate that in some embodiments the fingers 352A/352B may be arc shaped and nest with one another so as to easily receive and stretch the elastomeric band after the cutting operation. As shown in FIG. 7A, the stretcher fingers are in a closed position and are positioned adjacent one another wherein the closed fingers 352 are small enough to receive the cut band. Skilled artisans will appreciate that the different angles of the stretcher arms allow the fingers to be positioned as close as possible to one another when in the closed position, but without interfering in the other arm's movement when moved by the piston 274.

The stretcher arms operate when the air cylinder 270 receives a supply of pressurized air so as to direct the piston 274 upwardly. This causes the connected stretcher center linkage 300 to also move upwardly and the connected stretcher chains 310 cause the stretcher arms 320 to move upwardly and outwardly at the same time. When the pressurized air is withdrawn from the air cylinder 270 the piston 274 moves downwardly, thus retracting the center linkage 300 and the stretcher arms 320. The center linkage 300 may come in contact with the cushions 284 so as to prevent the stretcher aims 320 and the fingers 352 from inverting.

Figure 8A:
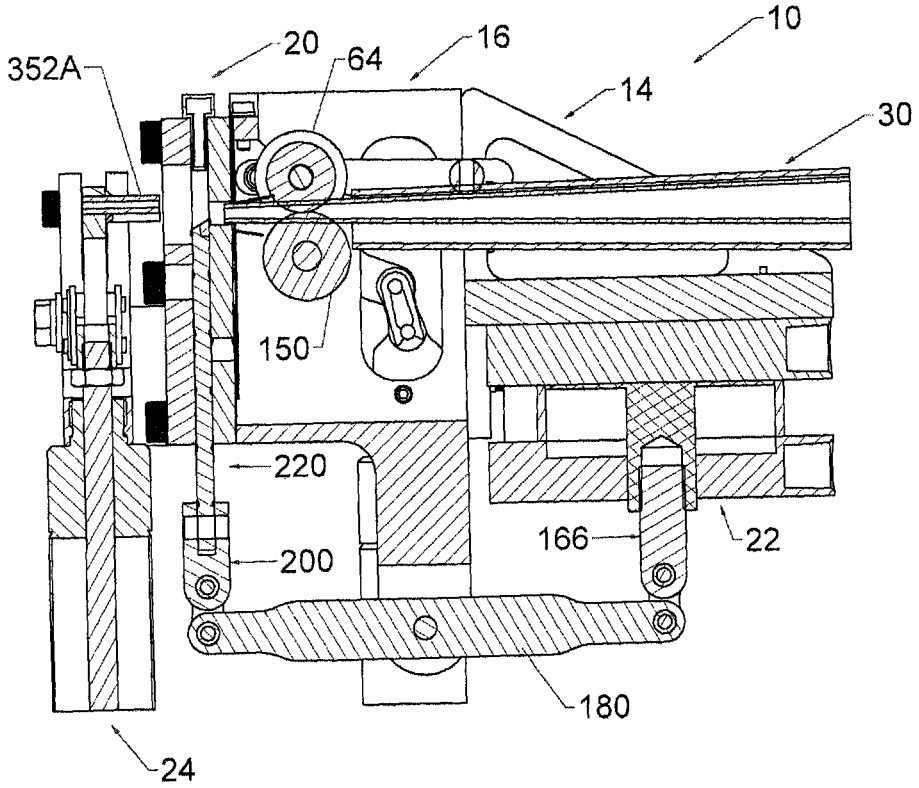
FIGS. 8A-D show partial cross-sectional views of the banding machine in various operational positions according to the concepts of the present invention.
Figure 8B:
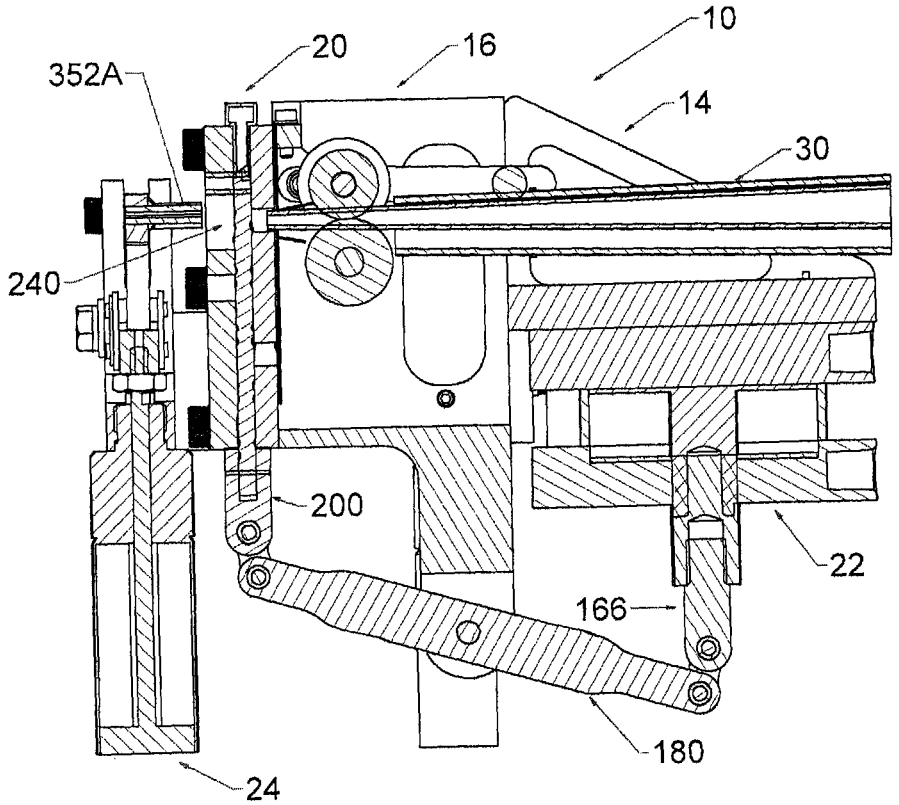
Figure 8C:
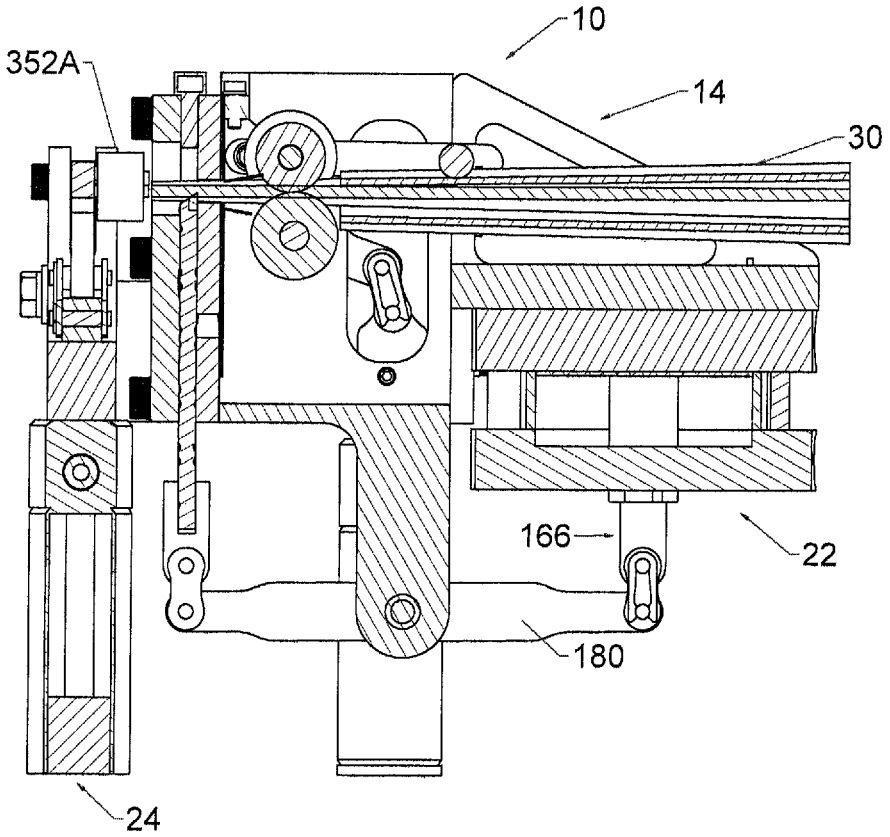
Figure 8D:
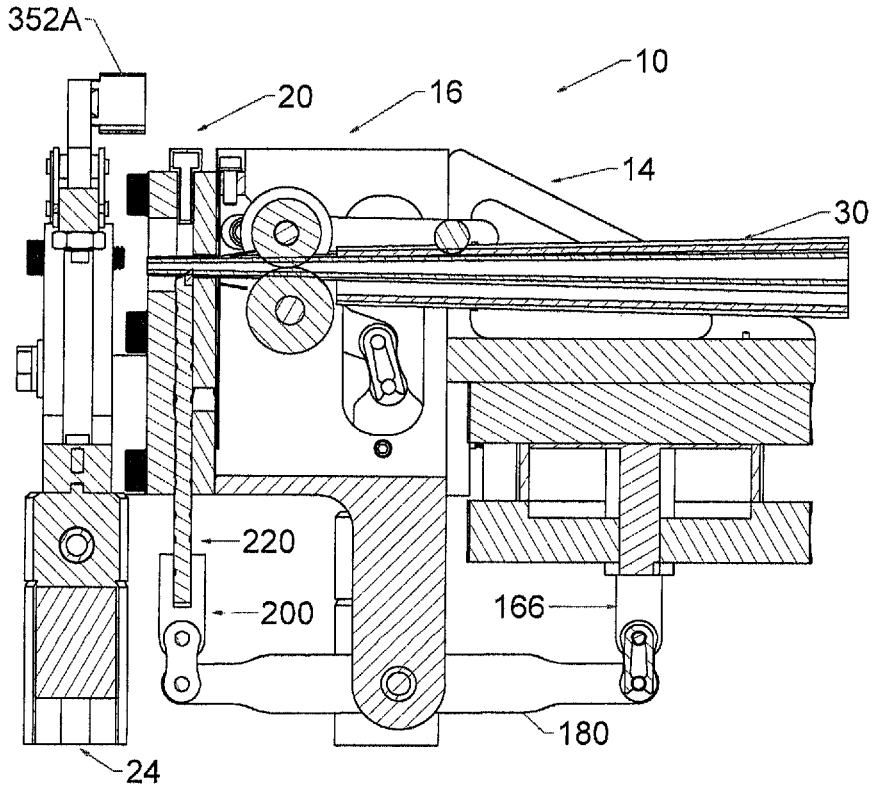
Figure 9:
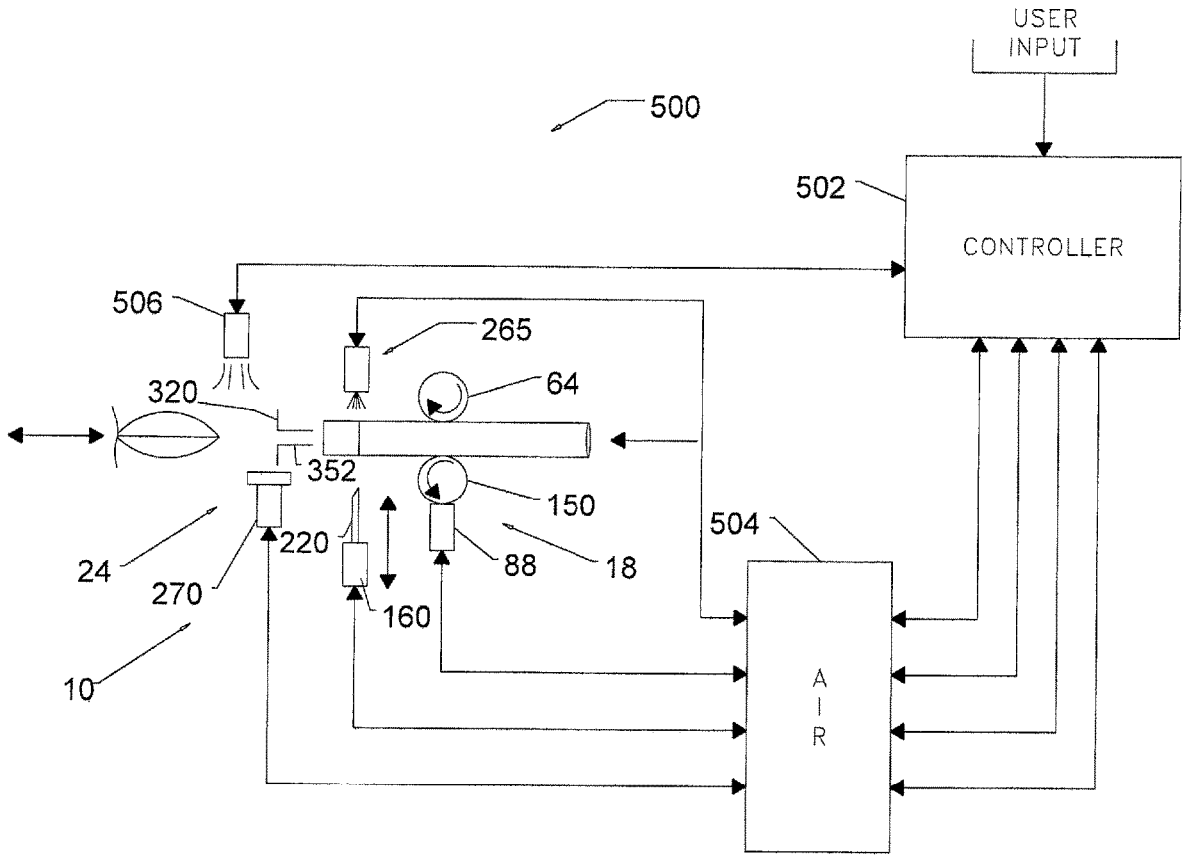
FIG. 9 is a schematic view of a control system utilized in operating the banding machine according to the concepts of the present invention.

FIGS. 8A-D show the various stages of the machine's cutting process, and FIG. 9 is a schematic diagram showing a control system designated generally by the numeral 500. The system 500 includes a controller 502 which provides the necessary hardware, software, and memory to implement operation of the machine 10. The controller 502 is connected to an air supply 504 so as to regulate delivery of pressurized air to the cylinders 88, 160 and 270. The controller 502 is also connected to a photo-eye 506 which detects placement and removal of the object which receives the cut band. The controller 502 receives electrical power as needed and any other input needed to control operation of the machine.

The overall operation of the banding machine is as follows. Initially, the elastomeric tube is fed into the tube guide assembly 14 at the entry end so that it exits out the exit end 36. During this time the machine may be operating in a manual mode so as to properly position the elastomeric tube with respect to the drive assembly 18 and the cutter assembly 22. In particular, the elastomeric tube is fed in between the idler roller 64 and the drive wheel 150 as shown in FIG. 8A.

The drive assembly, when actuated by the air supply 504, causes the piston 92 to move upwardly which drives the feed arm 114 so as to rotate the bearing clutch 130 and the associated drive shaft 134. In other words, the up motion of the piston angularly moves the finger 118 which in turn rotates the clutch 130 which rotates the drive shaft 134. When the piston 92 is retracted, the outer race of the clutch 130 rotates back but the inner race of the bearing clutch 130 maintains the current position of the drive shaft. In any event, the drive wheel 150, which is fixed to the drive shaft 134, rotates a corresponding amount. Accordingly, with the elastomeric tube received in between the drive wheel and the idler roller, the elastomeric tube is advanced into the knife gap 250.

At this time, the cutter assembly 22 is actuated so that the knife clevis 166 moves the rocker arm 180 downwardly such that it pivots at the pivot hole 186 which causes the attached knife blade 220 to move upwardly into the knife gap 250 as shown in FIG. 8B. The sharpened edge 224 engages the elastomeric tube which then engages the sharpened edge of the feed slot 234 so as to cut the tube to the specified length, which in most embodiments is determined by the amount of rotation of the drive wheel 150.

The corresponding down motion removes the knife blade away from the feed slot. As a result, the cut tube is repositioned into the band window 240. At selected times, the controller 502 may through the air supply 504 or directly actuate the lubrication system 265 to selectively dispense a predetermined amount of lubricant into the knife gap 250. The dispensed lubricant enters the grooves 228 and facilitates movement of the knife in the knife gap while ensuring a smooth and swift cutting of the elastomeric tube. In any event, a further motion of the drive wheel pushes the elastomeric tube past the tines and into the knife gap which in turn moves the previously cut piece of tubing onto the stretcher apparatus and, in particular onto the fingers 352A,B as shown in FIG. 8C. In other words, the piece of cut tubing returns to a position in the knife gap that is aligned with the uncut tubing. As the uncut tubing is advanced into the knife gap, the end of the uncut tubing propels the cut tubing onto the fingers 352A,B.

At this time the stretcher air cylinder 270 is activated and the stretcher assembly expands and pushes the stretcher arms upwardly so that they are no longer contained within the housing and outwardly so that an object may be inserted into the expanded band as shown in FIG. 8D. Indeed, as a result of the stretcher arms being expanded upwardly and outwardly away from the housing, the object to be banded can be axially inserted to any desired depth of the stretched band, before the operator moves the object so as to pull the band off the fingers. The photo-eye 506 detects the presence of the object, whereupon the controller causes the cylinder 270 to slightly relax for a short time so that the band begins to close around the object and is less tensioned by the fingers. At this time, the band contracts on to the object and the object is removed for placement in a container, assembly line, or some other station for further processing. At this time, the photo-eye 506 detects removal of the banded object and the controller causes the full retraction of the stretcher arm to its normal position to receive a next cut band.

As is apparent from the above description, there are numerous advantages to the banding machine 10. It is a compact and rugged machine which delivers a cut tube at a desired length. In particular, the cut tubing is presented outside of the housing while most all other operational components of the machine are maintained within the housing. This is advantageous in that debris associated with the related operations does not clog or interfere with the mechanisms of the machine. Indeed, the component parts of the machine are modular and can be easily serviced as needed. In other words, if a component part breaks or is damaged, it can be swapped out and replaced with minimal down time to the machine. The machine is also advantageous in that its cut length is adjustable with a simple mechanical adjustment and further adjustments can be made to transfer of the tubing within the machine prior to its cutting. Yet another advantage of the machine is that the cut tubing is advanced by the length of tubing to be cut, thus eliminating a cut tube transfer mechanism within the machine. Finally, the machine is advantageous in that it is adaptable for use with different objects ranging from lobster claws, clam shells, and vegetable stems. The machine is also able to accommodate different lengths of objects to be banded.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A banding machine comprising:

a tube guide adapted to transfer an elastomeric tube from an entry end to an exit end;

a frame assembly associated with said tube guide to receive the elastomeric tube from said exit end;

a drive assembly carried by said frame assembly, said drive assembly comprising a drive shaft selectively rotating a drive wheel which advances the elastomeric tube through the frame assembly;

a reciprocating knife;

a knife guide assembly associated with said frame assembly, said knife guide assembly receiving the reciprocating knife to cut the elastomeric tube to form a band; and a stretcher assembly comprising:

stretcher fingers maintained adjacent one another in a first position and adapted to receive the band, a stretcher piston;

a stretcher center linkage movable by said stretcher piston;

a top plate having a piston hole therethrough which slidably receives said stretcher piston;

a pair of frame arms extending from said top plate on either side of said piston hole; and a pair of stretcher arms connected at one end to said stretcher center linkage, each said stretcher arm having one of said stretcher fingers, wherein said stretcher fingers are movable away from each other to expand the band to a second position to receive an object upon which the band closes around.

2. The machine according to claim 1, further comprising:

an idler roller assembly carried by said frame assembly, said idler roller assembly having an idler roller which with said drive wheel forms a tube gap therebetween that receives and advances the elastomeric tube.

3. The machine according to claim 2, wherein said drive assembly further comprises:

a drive piston;

a feed arm coupled to said drive piston;

a one-way clutch bearing interposed between said drive piston and said feed arm such that movement of said drive piston in one direction rotates said drive shaft and movement of said drive piston in an opposite direction does not rotate said drive shaft.

4. The machine according to claim 1, further comprising:

a cutter assembly moving said reciprocating knife, said cutter assembly having a cutter piston connected at one end to a rocker arm, said reciprocating knife connected to an opposite end of said rocker arm, wherein movement of said cutter piston in one direction moves said reciprocating knife in an opposite direction.

5. The machine according to claim 4, wherein said reciprocating knife has at least one attachment hole therethrough and is attached to said rocker arm by a knife clevis which has a clevis pin that extends through said attachment hole, said reciprocating knife having more than one cutting edge so that different cutting edges can be used by reorientation of said reciprocating knife on said clevis pin.

6. The machine according to claim 5, wherein said knife guide assembly comprises:

an anvil plate having a slot which receives the elastomeric tube, said anvil plate having cutting edges around said slot to interact with one of said cutting edges of said reciprocating knife to cut the elastomeric tube into a band.

7. The machine according to claim 1, further comprising:

a housing having an opening, wherein said frame assembly, said tube guide, said drive assembly, said knife guide assembly, and said stretcher assembly are maintained within said housing, wherein said stretcher fingers expand from said first position inside said housing through said opening to said second position outside said housing so that the object can be inserted into the expanded band.

8. A banding machine for placing an elastomeric band around an object, comprising:

a drive assembly that receives and selectively advances an elastomeric tube;

a knife;

a knife guide assembly that receives the advanced elastomeric tube and which receives the knife that cuts the elastomeric tube to form the elastomeric band;

a stretcher assembly having at least two stretcher fingers to receive the band at a first position within a banding assembly housing, wherein said drive assembly advances the elastomeric tube to move the cut elastomeric band on to said at least two stretcher fingers, and wherein the at least two stretcher fingers are movable vertically and away from each other to expand the band to a second position outside the banding assembly housing to receive an object upon which the band closes around, wherein in the second position, the expanded band is located above the banding assembly housing and configured to receive the object in a horizontal direction; and an object detector detecting placement and removal of the object received within the expanded elastomeric band located in the second position outside of the banding assembly housing.

9. The banding machine according to claim 8, wherein said knife guide assembly comprises:

an anvil plate having at least one feed slot therethrough;

a knife guard having a band window extending therethrough and aligned with said at least one feed slot to receive the advanced elastomeric tube;

a pair of spacer plates disposed between said anvil plate and said knife guard so as to form a knife gap therebetween, said knife gap having a thickness equal to or less than a thickness of said knife;

wherein said anvil plate, said knife guard, and said pair of spacer plates are secured to one another with a plurality of fasteners each of which has associated therewith a spring washer so that said knife gap allows reciprocating passage of said knife therein.

10. The banding machine according to claim 9, wherein said knife has a cutting tapered edge and said at least one feed slot is formed by a cutting edge which co-acts with said knife's cutting tapered edge to cut the elastomeric tube.

11. The banding machine according to claim 10, wherein said knife has at least one lubrication groove on a surface facing at least said anvil plate or said knife guard.

12. The banding machine according to claim 11 further comprising:

a lubrication system that supplies a lubricant to said at least one lubrication groove.

13. A banding machine system, comprising:

a housing having an opening;

a drive assembly maintained within said housing and selectively moving an elastomeric tube;

a knife maintained within said housing and selectively cutting the elastomeric tube into an elastomeric band;

a pair of stretcher arms to receive the elastomeric band within the housing, move the elastomeric band vertically through the housing opening and expand the elastomeric band to create an expanded elastomeric band outside the housing, wherein the expanded elastomeric band is configured to receive an object in a horizontal direction when outside of the housing;

a controller associated with said drive assembly, said knife and said pair of stretcher arms to control operation thereof; and an object detector connected to said controller to detect the object received within the expanded elastomeric band located outside the housing.

14. The system according to claim 13, further comprising:

a pressurized air supply connected to said controller, wherein said controller controls flow of pressurized air to said drive assembly, said knife and said pair of stretcher arms to control operation thereof.

15. The system according to claim 14, wherein when the object detector detects an object received within the expanded elastomeric band outside the housing, the object detector initiates operation of said drive assembly, said knife and said pair of stretcher arms.

16. The system according to claim 14; further comprising:

a lubricating system connected to said controller to deliver a measured quantity of lubricant to said knife.

* * * * *